US005558089A

United States Patent [19]

Castiglione

[11] Patent Number: 5,558,089

[45] Date of Patent: Sep. 24, 1996

[54] RESPIRATOR NOSE CLIP

[75] Inventor: David M. Castiglione, South St. Paul, Minn.

[73] Assignee: Minnesota Mining and Manufacturing Company, St. Paul, Minn.

[21] Appl. No.: 578,073

[22] Filed: Dec. 27, 1995

Related U.S. Application Data

[63] Continuation of Ser. No. 322,576, Oct. 13, 1994.

[51] Int. Cl.[6] ..... A62B 7/10

[52] U.S. Cl. ..... 128/206.24; 128/203.29; 128/206.16; 128/206.18; 128/206.21; 128/207.11

[58] Field of Search ..... 128/201.24, 203.29, 128/205.25, 206.12, 206.16, 206.18, 206.19, 206.21, 206.24, 207.11

[56] References Cited

U.S. PATENT DOCUMENTS

| | | | |
|---|---|---|---|
| Re. 28,102 | 2/1970 | Mayhew | 128/146.2 |
| D. 132,545 | 1/1942 | Bulbulian . | |
| D. 343,307 | 1/1994 | Tennyson | D6/462 |
| 1,142,990 | 6/1915 | Stern . | |
| 1,914,418 | 2/1930 | Goyena . | |
| 2,153,437 | 6/1937 | Schwartz | 128/146 |
| 2,572,254 | 12/1949 | Folberth | 128/148 |
| 3,603,315 | 9/1971 | Becker | 128/146.2 |
| 3,682,171 | 8/1972 | Dali et al. | 128/206 |
| 3,982,532 | 9/1976 | Halldin et al. | 128/146 |
| 4,417,575 | 11/1983 | Hilton et al. | 128/206.16 |
| 4,590,775 | 5/1986 | Rivaud | 63/14 G |
| 4,600,002 | 7/1986 | Maryyanek et al. | 128/206.19 |
| 4,807,619 | 2/1989 | Dyrud et al. | 128/206.19 |
| 5,307,796 | 5/1994 | Kronzer et al. | 128/206.16 |
| 5,331,725 | 7/1994 | Chou | 24/545 |
| 5,374,458 | 12/1994 | Burgio | 128/206.19 |

FOREIGN PATENT DOCUMENTS

| | | | |
|---|---|---|---|
| 2304323 | 10/1976 | France | A61B 19/00 |
| 642224 | 2/1937 | Germany . | |
| 1092378 | 11/1967 | United Kingdom | A62B 17/02 |
| 2103491 | 2/1983 | United Kingdom | A62B 7/10 |

*Primary Examiner*—Edgar S. Burr
*Assistant Examiner*—V. Srivastava
*Attorney, Agent, or Firm*—Gary L. Griswold; Walter N. Kirn; Karl G. Hanson

[57] ABSTRACT

A nose clip 12 useful for fitting a respirator 10 over a person's nose. The nose clip 12 includes a non-linear strip 18 that has first and second wings 20 and 22 and a midsection 24. There are first, second, and third inflections 26, 28, and 30 disposed, respectively, between the first wing 20 and the midsection 24, centrally in the midsection 24, and between the midsection 24 and the second wing 22.

20 Claims, 2 Drawing Sheets

RESPIRATOR NOSE CLIP

This is a continuation of application Ser. No. 08/322,576 filed Oct. 13, 1994.

TECHNICAL FIELD

The present invention pertains to a nose clip that is sized and shaped for providing a respirator with a snug fit over a person's nose and in the region where the nose meets the cheek. The invention also pertains to a new respirator and a method of fitting a respirator to a person's face.

BACKGROUND OF THE INVENTION

Respirators (also referred to as "filtering face masks") are worn over the breathing passages of a person for two common purposes: (1) to prevent impurities or contaminants from entering the wearer's breathing track; and (2) to protect others from being exposed to pathogens and other contaminants exhaled by the wearer. In the first situation, the respirator is worn in an environment where the air contains particles harmful to the wearer, for example, in an auto body shop. In the second situation, the respirator is worn in an environment where there is a high risk of infection, for example, in an operating room.

To accomplish either of the above-stated purposes, the respirator must be able to maintain a snug fit to the wearer's face. Known respirators can, for the most part, match the contour of a person's face over the cheeks and chin. In the nose region, however, there is a radical change in contour, which makes it difficult to achieve a snug fit over that portion of the wearer's face. The failure to obtain a snug fit allows air to enter or exit the interior of the respirator without passing through the filter media. When inhaled and exhaled air is not filtered, contaminants may enter the wearer's breathing track or others may be exposed to contaminants exhaled by the wearer. In addition, the wearer's eyeglasses can become fogged by exhaled air that escapes from the interior of the respirator over the nose region, making visibility more troublesome to the wearer.

Nose clips are commonly used on respirators to achieve a snug fit over the nose of the wearer. Conventional nose clips are in the form of malleable, dead soft, linear, strips of aluminum—see, for example, U.S. Pat. Nos. 5,307,796, 4,600,002, 3,603,315; see also U.K. Patent Application GB 2,103,491 A. Conventional nose clips have provided a snug fit over the nose of the wearer, but the fit frequently has been obtained at the expense of restricting flow through the wearer's nasal passages. In addition, conventional nose clips are known to exert a clamping pressure on the wearer's nose and/or cheekbone, and this clamping pressure also can cause discomfort. Other nose clips have been disclosed in the art—see, for example, U.S. Pat. Nos. 2,153,437 and 2,572,254. These nose clips have the drawback of not extending over the bridge of the nose (they pass in front of the entrance to the nasal passages) and therefore are not very good candidates for commercial use on a conventional "cup-shaped" or "flat-folded" respirator.

SUMMARY OF THE INVENTION

The present invention provides a new nose clip that allows a respirator to form a snug fit over the nose of a wearer, in the region where the nose meets the cheek, and on the cheek beneath the eye. The snug fit can be achieved without substantially restricting flow through the nasal passages of the wearer. The nose clip helps prevent inhaled and exhaled air from passing from the interior of the respirator to the exterior or vice versa without passing through the filter media. This improves the protection afforded by the respirator to the wearer and others who may be exposed to contaminants exhaled by the wearer. The nose clip also helps prevent a wearer's eyeglasses from becoming fogged by exhaled air that escapes from the interior of the mask over the nose and beneath the eyes.

In brief summary, the nose clip of the invention includes:

(a) a non-linear strip that has first and second wings and a midsection disposed between the first and second wings, the midsection has first and second frame members joined together and offset from each other at an angle $\alpha$ of 45 to 179 degrees; and (b) first, second, and third inflections disposed on the non-linear strip between the first wing and the midsection, centrally in the midsection, and between the midsection and the second wing, respectively. The nose clip is sized and shaped for securement to a respirator to assist in fitting the respirator over a person's nose.

The present invention also provides a new respirator that comprises:

(a) a respirator body adapted to fit at least over the nose and mouth of a person; and (b) a nose clip attached to the respirator body to assist in fitting the respirator over the person's nose, the nose clip comprising a non-linear strip that has first and second wings and a midsection comprising first and second frame members joined together and attached to the first and second wings, respectively, the midsection being configured to extend over the bridge of a person's nose when the respirator is being worn, the nose clip also having first, second, and third inflections disposed between the first wing and the midsection, centrally in the midsection, and between the midsection and the second wing, respectively.

In a further aspect, the invention provides a method of fitting a respirator to a person's face, which method comprises:

(a) providing a respirator that comprises:

(i) a respirator body adapted to fit at least over the nose and mouth of a person; and (ii) a nose clip attached to the respirator body to assist in fitting the respirator over the person's nose, the nose clip comprising a non-linear strip that has first and second wings and a midsection comprising first and second frame members joined together and attached to the first and second wings, respectively, the midsection being configured to extend over the bridge of a person's nose when the respirator is being worn, the nose clip also having first, second, and third inflections disposed between the first wing and the midsection, centrally in the midsection, and between the midsection and the second wing, respectively;

(b) placing the respirator over the person's nose and mouth; and (c) deforming the nose clip so that a snug fit is provided over the person's nose, in the region where the cheek meets the nose, and on the cheek beneath each eye.

The nose clip of the invention has a unique shape that differs from known respirator nose clips. Nose clips that are commonplace in the respirator art are linear in shape when viewed from the front—see, for example, U.S. Pat. No. 5,307,796. Other known nose clips have a chevron shape—see, for example, GB 2,103,491 A. In contrast, the nose clip of the invention has three inflections disposed on a nonlinear strip. From a first end of the non-linear strip to the first inflection there is a first wing. From the first inflection to the third inflection there is a midsection. From the third inflection to the second end of the non-linear strip there is a second wing. In a preferred embodiment, the midsection comprises two frame members that are offset from each other at an angle α of 45 to 179 degrees. The first and second frame members are attached to the first and second wings, respectively. The first and second wings and the first and third inflections on the nose clip enable a snug fit to be obtained in the region where the nose meets the cheek. The midsection enables a snug fit to be obtained over the bridge of the wearer's nose. The wings also assist in sealing along the cheek beneath each eye. The fit provided by the nose clip makes it more likely that contaminants will pass through the filter media of the respirator, thereby enhancing safety for the wearer and others and preventing fogging of a wearer's eyeglasses.

These and other advantages of the invention are more fully shown and described in the drawings and detailed description of this invention, where like reference numerals are used to represent similar parts. It is to be understood, however, that the drawings and description are for the purposes of illustration only and should not be read in a manner that would unduly limit the scope of this invention.

FIGS. *3a–3c* illustrate alternative embodiments of nose clips 12', 12", and 12''' in accordance with the present invention.

DETAILED DESCRIPTION OF THE PREFERRED EMBODIMENTS

Figure 1:
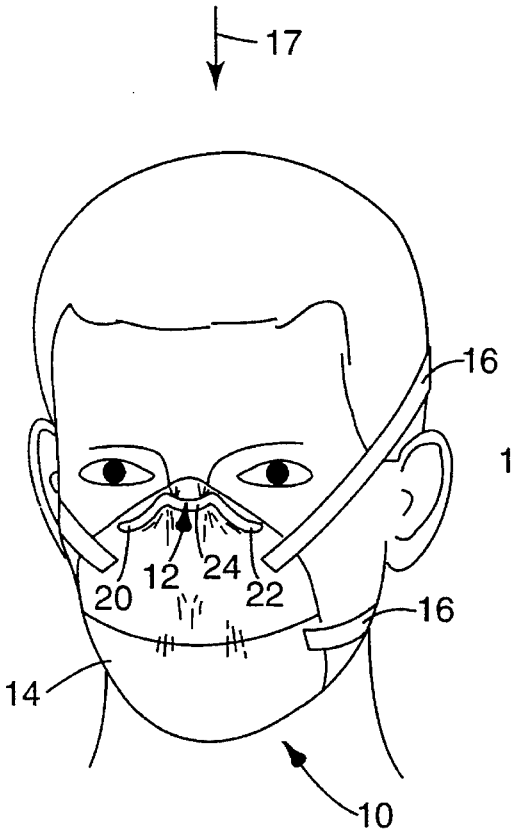
FIG. 1 illustrates an isometric front view of a respirator 10 in accordance with the present invention disposed over the nose and mouth of a wearer.
Figure 2:
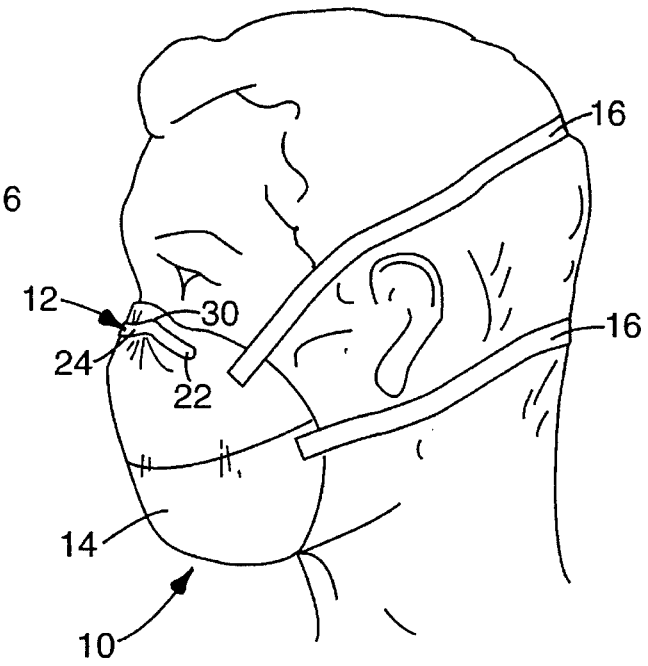
FIG. 2 illustrates a side view of a respirator 10 in accordance with the present invention disposed over the nose and mouth of a wearer.

In the practice of the present invention, a respirator 10 is provided as shown in FIGS. 1 and 2 that has nose clip 12 secured to a respirator body 14 to allow respirator body 14 to fit snugly over the wearer's nose, in the area where the nose meets the cheek, and on the upper portion of the cheek beneath each eye. As the terms are used herein, "respirator" is used in a generic sense to mean a filtering device that fits over the nose and mouth of a person, and "fit snugly" or "snug fit" means that an essentially air-tight fit is provided between the respirator and the face of the wearer. Straps 16 are attached to respirator body 14 and are sized to pass behind the wearer's head to assist in providing a snug fit to the wearer's face.

Figure 3:
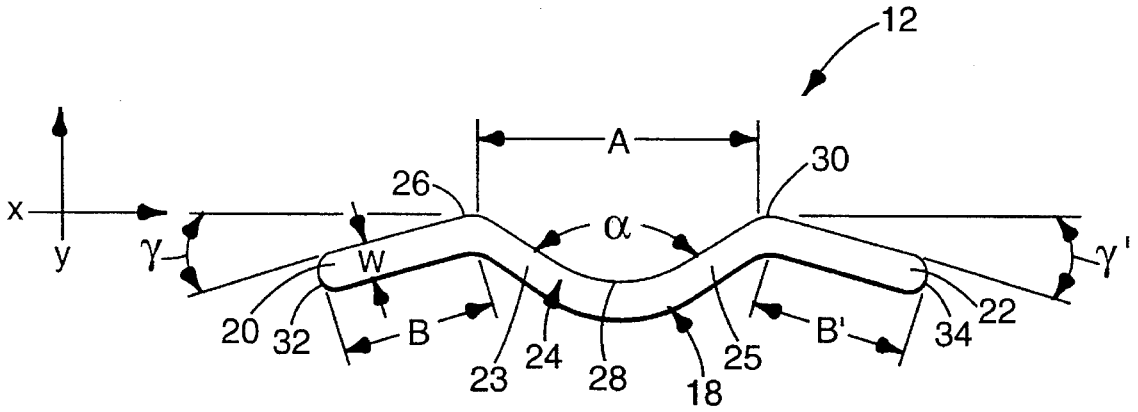
FIG. 3 illustrates a front view of a nose clip 12 in accordance with the present invention.

Referring particularly to FIG. 3 (which corresponds to a view of nose clip 12 as taken from above in the direction of arrow 17, FIG. 1), nose clip 12 is shown to comprise a non-linear strip 18 that has first and second wings 20 and 22 and a midsection 24 disposed between the first and second wings 20 and 22. The midsection 24 is configured so that it extends over the bridge of a person's nose when the respirator is worn by a person (FIG. 1 and FIG. 2). The midsection 24 includes first and second frame members 23 and 25 that extend from the first and second wings 20 and 22, respectively. The frame members 23 and 25 are joined together centrally in the midsection 24. The term "joined together" means the frame members are connected to each other, not necessarily directly connected. The non-linear strip also has a first inflection 26, a second inflection 28, and a third inflection 30. As the term is used herein, "inflection" means that a tangent to the slope of the curve as defined by the path of the nonlinear strip, changes from positive slope to a negative slope or vice versa. The term "curve" is used herein in its mathematical sense to include a straight line. To further illustrate what is meant by an inflection, consider the non-linear strip 18 projected on the XY plane with the first inflection 26 and the third inflection 30 both located on the X axis. A line tangent to the first wing 20 increases in slope (positive slope) from end 32 until it reaches inflection 26, and thereafter the tangent line begins to decrease in slope (negative slope) until the second inflection 28 is reached. Proceeding further from second inflection 28, a line tangent to the curved midsection 24 has a positive slope until inflection 30 is reached, and thereafter is negative in slope until the second end 34 is reached.

The length of wings 20 and 22, as defined by the distance between the end 32 or 34 and the inflection 26 or 30, is noted by the capital letter B and B', respectively, and generally is about 10 to 40 millimeters (ram) in length, preferably about 15 to 30 mm in length, and more preferably about 20 to 25 mm in length. The distance A between the first inflection 26 and the third inflection 30 generally is about 35 to 55 mm in length, and preferably is about 40 to 50 mm in length. Midsection 24 has first and second frame members 23 and 25 offset from each other by angle α, an included angle of about 45 to 179 degrees, preferably of about 75 to 150, more preferably of about 90 to 125 degrees, and most preferably of about 100 to 115 degrees. The first and second wings 20 and 22 are offset from the X axis at an angle γ and γ, respectively, of about 20 to 40 degrees, preferably at about 30 to 35 degrees, when the first and third inflections 26 and 30 are disposed thereon as shown in FIG. 3. Further reference to angles "γ" and "γ" means those angles as described in the previous sentence. The non-linear strip preferably has a width w of about 2 to 10 mm, preferably 3 to 6 mm. The width w may or may not be constant but preferably falls within the aforementioned ranges. The thickness of the non-linear strip (in the direction of the z axis (not shown)) preferably is about 0.7 to 1.1 mm for a respirator of moderate thickness but may be as low as 0.4 mm for very thin masks or up to approximately 1.5 mm for thicker masks. The thickness also may vary along the nonlinear strip, but nonetheless preferably falls within the aforementioned ranges. Although the non-linear strip 18 has been described as having a generally rectangular cross-section, it is possible for the non-linear strip to have a cross-section that is round, triangular, elliptical, et cetera. Nose clips comprising non-linear strips that have such cross-sections are considered to be within the scope of this invention.

The nose clip preferably is formed from a malleable metal such as aluminum. An alloy of aluminum preferably is used, for example, aluminum alloy 3003 (Aluminum Association Designation). The nose clip also could be made from other materials such as steel or a plastic-encased metal. The term "malleable" is used herein to mean the nose clip can be conformed by mere finger pressure. The nose clip preferably is dead soft so that when conformed to the face of the wearer, it retains the conformed position until it is readjusted or altered by the wearer. In lieu of a malleable, dead soft, nose clip, it also may be possible in this invention to use a spring clip having the configuration as described. The nose clip may be secured to the respirator body by an adhesive, for example, a pressure-sensitive adhesive or a hot-melt adhesive. A hot-melt film adhesive can be applied to the nose clip before it is stamped, or a pressure-sensitive adhesive or liquid hot-melt adhesive can be applied at the time of attachment to the mask. Examples of hot-melt film adhesives that may be used include Scotchweld™ EC4060 (3M, St. Paul, Minn.). Alternatively, the nose clip may be encased in the body of the respirator or may be held between the respirator body and a cloth that is mechanically fastened thereto.

The nose clip can be conformed to fit over the wearer's nose by bending the midsection into a shape that corresponds to the curvature of the bridge of the wearer's nose. A first and third inflections may be pressed towards the check at the base of the nose bridge to preclude air from passing between the respirator body and the wearer's face in the region where the nose meets the cheek. The wings can be conformed to correspond to the contour of the wearer's face on the cheek beneath the eye.

Figure 3A:
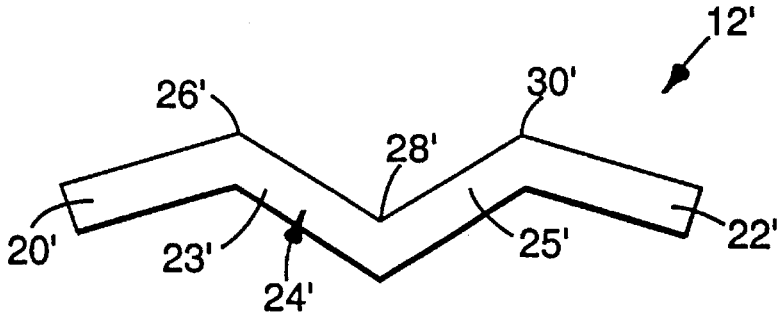
Figure 3B:
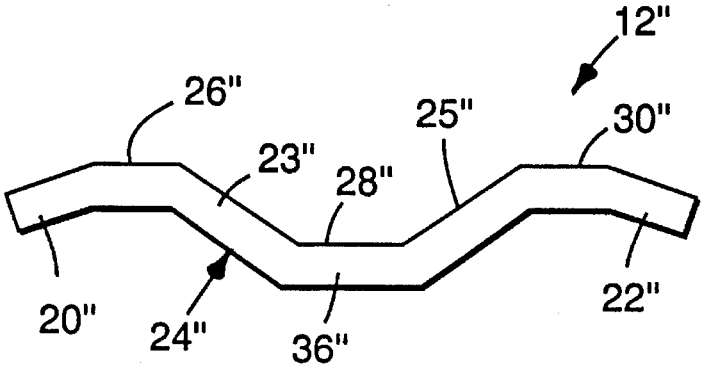
Figure 3C:
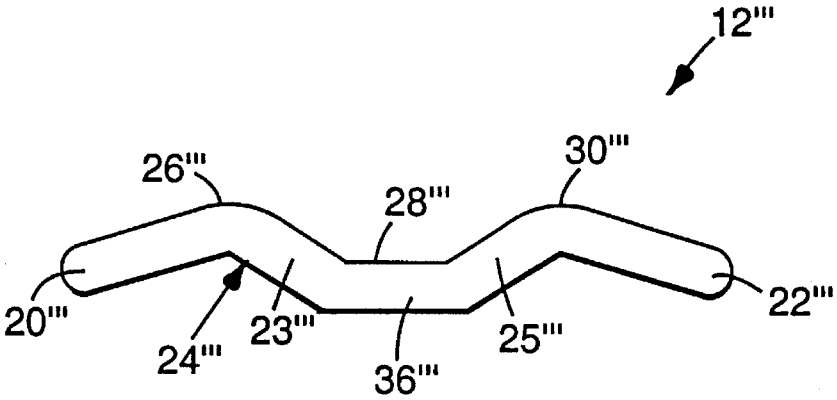

The nose clip may take on configurations other than the embodiment shown in FIG. 3. For example, as shown in FIG. 3*a*, a nose clip 12' may be provided which has a less rounded configuration, the wings 20' and 22' are completely linear and the midsection 24' includes two linear frame members 23' and 25'. In the embodiment shown in FIG. 3*a*, the inflections 26', 28' and 30' are more drastically defined than the embodiment of FIG. 3. In the embodiment of FIG. 3*b*, the nose clip 12" has inflections 26", 28", and 30" that are defined by lines rather than points. The embodiment of FIG. 3*b* also differs in that first and second frame members 23" and 25" are joined together by a central frame member 36". The nose clip 12''' illustrated in FIG. 3*c* combines various aspects of the embodiments shown in FIGS. 3, 3*a*, and 3*b*. As illustrated in each of the figures, the nose clip preferably has mirror symmetry about a plane that centrally bisects the non-linear strip. Although a single nose clip is shown to be fastened to the respirator body, it also may be possible to use a plurality of nose clips to obtain a snug fit.

The respirator body may be of a curved, hemispherical, cup-shape such as shown in U.S. Pat. No. 4,536,440 to Berg, U.S. Pat. No. 4,807,619 to Dyrud et at., or U.S. Pat. No. 5,307,796 to Kronzer et at. The respirator body also may take on other shapes as so desired. For example, the respirator body can be a cup-shaped mask having a construction as shown in U.S. Pat. No. 4,827,924 to Japuntich. The respirator body 14 may comprise an inner shaping layer and an outer filtration layer (not shown). The shaping layer provides structure to the respirator body and support for the filtration layer. The shaping layer may be located on the inside and/or outside of the filtration layer and can be made, for example, from a non-woven web of thermally-bondable fibers molded into a cup-shaped configuration, for example, by the method taught in the Kronzer et al. patent. The filtration media preferably is a web of electrically charged melt-blown microfibers. The respirator can have an exhalation valve located thereon such as the unidirectional fluid valve disclosed in U.S. Pat. No. 5,325,892 to Japuntich et al. The respirator also may be a fiat-folded respirator such as disclosed in U.S. Pat. Nos. 4,419,993, 4,419,994, 4,300,549, 4,802,473, or Re. 28,102. The disclosures of the above-cited patents are incorporated here by reference.

The straps 16 preferably may be made of an elastic material that causes the respirator body 14 to exert a slight pressure on the face of the wearer. A number of different materials may be suitable for use as strap 16, for example, the straps may be formed from a thermoplastic elastomer that is ultrasonically welded to the respirator body. The 3M 8710 respirator is an example of an respirator that employs ultrasonically welded straps. Woven cotton elastic bands, rubber cords or strands (e.g. polyisoprene rubber) also may be used, as well as non-elastic adjustable straps.

In view of the above, it is apparent that this invention may take on various modifications and alterations. It is to be understood, therefore, that this invention is not to be limited to the above-described, but is to be controlled by the limitations set forth in the following claims and any equivalents thereof. It is also to be understood that this invention may be suitably practiced in the absence of any element not specifically disclosed herein.

What is claimed is:

1. A nose-clip sized and shaped for securement to a respirator to assist in fitting the respirator over a person's nose, the nose-clip comprising:

a non-linear strip that when projected on an XY plane and viewed from the front has first, second, and third inflections, first and second wings, and a midsection, the midsection being disposed between the first and second wings and having first and second frame members that are joined together and offset from each other at an angle $\alpha$ of 45 to 179 degrees, the first, second, and third inflections being disposed on the non-linear strip between the first wing and the midsection, centrally in the midsection, and between the midsection and the second wing, respectively.

2. The nose clip of claim 1, wherein the first and second wings each have a length of 10 to 40 millimeters.

3. The nose clip of claim 2, wherein the first and second wings each have a length of 15 to 30 millimeters.

4. The nose clip of claim 3, wherein the first and second wings each have a length of 20 to 25 millimeters.

5. The nose clip of claim 1, wherein the distance between the first inflection and the third inflection is 35 to 55 millimeters.

6. The nose clip of claim 5, wherein the distance between the first inflection and the third inflection is 40 to 50 millimeters.

7. The nose clip of claim 1, wherein angle $\alpha$ is 90 to 125 degrees.

8. The nose clip of claim 7, wherein the angle $\alpha$ is 100 to 115 degrees.

9. The nose clip of claim 1, wherein the first and second wings are each offset at an angle $\gamma$ and $\gamma'$, respectively, of about 20 to 40 degrees.

10. The nose clip of claim 9, wherein the angles $\gamma$ and $\gamma'$ are 30 to 35 degrees.

11. The nose clip of claim 1, wherein the non-linear strip has a width of 2 to 10 millimeters and a thickness of 0.4 to 1.5 millimeters.

12. The nose clip of claim 11, wherein the non-linear strip has a width of 3 to 6 millimeters and a thickness of 0.7 to 1.1. millimeters.

13. The nose clip of claim 1, wherein the non-linear strip comprises a malleable, dead soft material.

14. The nose clip of claim 1, wherein the first and second frame members are joined together by a central frame member.

15. The nose clip of claim 1, wherein the nose clip has mirror symmetry about a plane that centrally bisects the non-linear strip.

16. A respirator that comprises:

(a) a respirator body adapted to fit at least over the nose and mouth of a person; and (b) a nose clip attached to the respirator body to assist in fitting the respirator over the person's nose, the nose clip strip comprising a non-linear strip that has first and second wings and a midsection comprising first and second frame members joined together and attached to the first and second wings, respectively, the midsection being configured to extend over the bridge of a person's nose when the respirator is being worn, the nose clip when projected on an XY plane and viewed from the front also has first, second, and third inflections disposed between the first wing and the midsection, centrally in the midsection, and between the midsection and the second wing, respectively.

17. The respirator of claim 16, wherein the first and second wings each have a length of 10 to 40 millimeters, and the distance between the first inflection and the third inflection is 35 to 55 millimeters, and wherein angle $\alpha$ is 75 to 150 degrees, and the first and second wings are each offset at an angle $\gamma$ and $\gamma'$, respectively, of about 20 to 40 degrees.

18. The respirator of claim 16, wherein the first and second wings each have a length of 15 to 30 millimeters, and the distance between the first inflection and the third inflection is 40 to 50 millimeters, and wherein the angle $\alpha$ is 90 to 125 degrees, the angles $\gamma$ and $\gamma'$ are 30 to 35 degrees, and the non-linear strip is formed of a malleable, dead soft material.

19. The respirator of claim 16, wherein the angle $\alpha$ is 100 to 115 degrees, the non-linear strip is formed of a malleable, dead soft material, and the nose clip is symmetrically configured about a plane that centrally bisects the non-linear strip.

20. A method of fitting a respirator to a person's face, which method comprises:

(a) providing a respirator that comprises:

(i) a respirator body adapted to fit at least over the nose and mouth of a person; and (ii) a nose clip attached to the respirator body to assist in fitting the respirator over the person's nose, the nose clip comprising a non-linear strip that has first and second wings and a midsection comprising first and second frame members joined together and attached to the first and second wings, respectively, the midsection being configured to extend over the bridge of a person's nose when the respirator is being worn, the nose clip when projected on an XY plane and viewed from the from also has first, second, and third inflections disposed between the first wing and the midsection, centrally in the midsection, and between the midsection and the second wing, respectively;

(b) placing the respirator over the person's nose and mouth; and (c) deforming the nose clip so that a snug fit is provided over the person's nose, in the region where the cheek meets the nose, and on the cheek beneath each eye.

* * * * *

UNITED STATES PATENT AND TRADEMARK OFFICE

CERTIFICATE OF CORRECTION

PATENT NO. : 5,558,089

DATED : September 24, 1996

INVENTOR(S) : David M. Castiglione

It is certified that error appears in the above-indentified patent and that said Letters Patent is hereby corrected as shown below:

Col. 4, line 24, "(ram)" should read --(mm)--.

Col. 4, line 38, the second occurrence of " "γ" " should read --"γ' "-.

Signed and Sealed this

Eighteenth Day of February, 1997

*Attest:*

*Attesting Officer*

Bruce Lehman

BRUCE LEHMAN

*Commissioner of Patents and Trademarks*